US007541534B2

(12) United States Patent
Schnepel et al.

(10) Patent No.: US 7,541,534 B2
(45) Date of Patent: Jun. 2, 2009

(54) METHODS AND APPARATUS FOR RENDERING AUDIO DATA

(75) Inventors: Soenke Schnepel, Luetjensee (DE); Stefan Wiegand, Hamburg (DE); Sven Duwenhorst, Hamburg (DE); Volker W Duddeck, Hamburg (DE); Holger Classen, Hamburg (DE)

(73) Assignee: Adobe Systems Incorporated, San Jose, CA (US)

( * ) Notice: Subject to any disclaimer, the term of this patent is extended or adjusted under 35 U.S.C. 154(b) by 20 days.

(21) Appl. No.: 11/585,325

(22) Filed: Oct. 23, 2006

(65) Prior Publication Data

US 2008/0092721 A1 Apr. 24, 2008

(51) Int. Cl.
*G10H 7/00* (2006.01)
*G10H 5/00* (2006.01)

(52) U.S. Cl. ..... 84/609; 84/604; 84/616; 84/618; 84/649; 84/667

(58) Field of Classification Search ..... 84/600–607, 84/609–611, 613–618, 634, 635, 637, 649–651, 84/653–656, 666, 667
See application file for complete search history.

(56) References Cited

U.S. PATENT DOCUMENTS

| | | | | | |
|---|---|---|---|---|---|
| 4,881,440 | A * | 11/1989 | Kakizaki | 84/609 |
| RE33,739 | E * | 11/1991 | Takashima et al. | 84/603 |
| 5,525,749 | A * | 6/1996 | Aoki | 84/609 |
| 5,728,962 | A * | 3/1998 | Goede | 84/609 |
| 5,753,843 | A * | 5/1998 | Fay | 84/609 |
| 6,452,082 | B1 * | 9/2002 | Suzuki et al. | 84/609 |
| 6,541,689 | B1 * | 4/2003 | Fay et al. | 84/601 |
| 6,646,194 | B2 * | 11/2003 | Kikumoto | 84/600 |
| 6,872,877 | B2 * | 3/2005 | Suzuki et al. | 84/609 |
| 2001/0023635 | A1 * | 9/2001 | Taruguchi et al. | 84/609 |
| 2002/0005109 | A1 * | 1/2002 | Miller | 84/609 |
| 2002/0189430 | A1 * | 12/2002 | Mukojima | 84/615 |
| 2003/0004701 | A1 * | 1/2003 | Ueta et al. | 704/1 |
| 2003/0177892 | A1 * | 9/2003 | Akazawa et al. | 84/616 |
| 2004/0089141 | A1 * | 5/2004 | Georges et al. | 84/609 |
| 2004/0255759 | A1 * | 12/2004 | Gayama | 84/613 |
| 2005/0016364 | A1 * | 1/2005 | Kamiya | 84/627 |

* cited by examiner

*Primary Examiner*—Jeffrey Donels
*Assistant Examiner*—Christopher Uhlir
(74) *Attorney, Agent, or Firm*—Barry W. Chapin, Esq.; Chapin IP Law, LLC

(57) ABSTRACT

An audio management application includes a recombiner and aggregation rules to manipulate and recombine segments of a musical piece such that the resulting finished composition includes parts (segments) from the decomposed piece, typically a song, adjustable for length by selectively replicating particular parts and combining with other parts such that the finished composition provides a similar audio experience in the predetermined duration. The architecture defines the parts with part variations of independent length, identified as performing a function of starting, middle, (looping) or ending parts. Each of the parts provides a musical segment that is integratable with other parts in a seamless manner that avoids audible artifacts (e.g. "pops" and "crackles") common with conventional mechanical switching and mixing. Each of the parts further includes attributes indicative of the manner in which the part may be ordered, whether the part may be replicated or "looped," and modifiers affecting melody and harmony of the rendered finished composition piece.

22 Claims, 8 Drawing Sheets

METHODS AND APPARATUS FOR RENDERING AUDIO DATA

BACKGROUND

Conventional sound amplification and mixing systems have been employed for processing a musical score from a fixed medium to a rendered audible signal perceptible to a user or audience. The advent of digitally recorded music via CDs coupled with widely available processor systems (i.e. PCs) has made digital processing of music available to even a casual home listener or audiophile. Conventional analog recordings have been replaced by audio information from a magnetic or optical recording device, often in a small personal device such as MP3 and Ipod® devices, for example. In a managed information environment, audio information is stored and rendered as a song, or score, to a user via speaker devices operable to produce the corresponding audible sound to a user.

In a similar manner, computer based applications are able to manipulate audio information stored in audio files according to complex, robust mixing and switching techniques formerly available only to professional musicians and recording studios. Novice and recreational users of so-called "multimedia" applications are able to integrate and combine various forms of data such as video, still photographs, music, and text on a conventional PC, and can generate output in the form of audible and visual images that may be played and/or shown to an audience, or transferred to a suitable device for further activity.

SUMMARY

Digitally recorded audio has greatly enabled the ability of home or novice audiophiles to amplify and mix sound data from a musical source in a manner once only available to professionals. Conventional sound editing applications allow a user to modify perceptible aspects of sound, such as bass and treble, as well as adjust the length by performing stretching or compressing on the information relative to the time over which the conventional information is rendered.

Conventional sound applications, however, suffer from the shortcoming that modifying the duration (i.e. time length) of an audio piece changes the tempo because the compression and expansion techniques employed alter the amount of information rendered in a given time, tending to "speed up" or "slow down" the perceived audio (e.g. music). Also, it can be difficult for novice users to combine portions of audio to meet a prescribed desired time duration. Further, conventional applications cannot rearrange discrete portions of the musical score without perceptible inconsistencies or artifacts (i.e. "crackles", "phase erasement" or "pops") as the audio information is switched, or transitions, from one portion to another.

Accordingly, configurations herein substantially overcome the shortcomings presented by conventional audio mixing and processing applications by defining an architecture and mechanism of storing audio information in a manner operable to be rearranged, or recombined, from discrete parts of the audio information into a finished musical composition piece of a predetermined length without detectable inconsistencies between the integrated audio parts from which it is combined. The example audio rearranger presented herein rearranges an audio piece (song) by concatenating the constituent parts into a finished composition having a predetermined duration (length). The method identifies a decomposed set of audio information in a file format indicative of a time and relative position of parts of the musical score, or piece, and identifies, for each part, a function and position in the recombined finished composition. Each of the stored parts is operable to be recombined into a seamless, continuous composition of a predetermined length providing a consistent user listening experience despite variations in duration.

The disclosed configuration provides time specification and limiting while adhering to a general musical experience by using a minimization technique that selects a song structure with least repetition. The minimizing technique further deviates minimally from the structure to achieve the desired length by rearranging the parts in the same or similar structure as the original. Employing such a rearranger allows less skilled users to adjust pre-composed songs to a desired length without involving a composer and thus mitigating resource (time and money) usage in developing a time conformant rendering of a song or other musical score.

The example shown herein presents an audio editing application that employs aggregation rules applicable to the parts of a song to produce a logical sequence of musical parts based on the type of the parts. The aggregation rules identify an ordering of the parts in the recombined, finished composition. A set of song structures identifies a mapping of sequential types of song parts that indicate allowable ordering of the types. In concurrence with the aggregation rules, the recombiner selects parts of a particular length to satisfy the desired total duration. Certain parts may be replicated in succession, to produce a duration multiple (e.g. 2 times, 3 times, etc.) of a part. The parts may also have part variations including similarly renderable (i.e. sounding similar) parts with a different duration. The aggregation rules attempt to minimize repetition while maintaining musical structure (i.e. logical part progression) in the finished composition.

The disclosed recombination mechanism allows the audio editing application to manipulate and recombine segments of a musical piece such that the resulting finished composition includes parts (segments) from the decomposed piece, typically a song, adjustable for length by selectively replicating particular parts and combining with other parts such that the finished composition provides a similar audio experience in the predetermined duration. The segments define the parts with part variations of independent length, and identified as performing a function of starting, middle, (looping) or ending parts. Each of the parts provides a musical segment that is integratable with other parts in a seamless manner that avoids audible artifacts (e.g. "pops" and "clicks" or "phase erasement") common with conventional mechanical switching and mixing. Each of the parts further includes attributes indicative of the manner in which the part may be ordered, whether the part may be replicated or "looped" and modifiers affecting melody and harmony of the rendered finished composition piece, for example.

In further detail the method of processing and rendering audio information as disclosed herein includes computing a plurality of parts of an audio piece, such that each of the parts has a function and a duration, in which the function is indicative of a recombinable order of the parts, and the duration is indicative of a time length of the part. A file repository organizes each of the parts according to length and function, and a rearranger arranges a sequence of the parts according to an aggregate duration, in which arranging further includes ordering the parts according to the function of the preceding part and the combined duration of the aggregate parts.

In an example configuration, arranging the parts further includes gathering, from an audio source, a set of parts of the audio piece, each of the parts having a duration and a function, in which the function is indicative of the ordering of the parts in a renderable audio composition. A recombiner combines the set of parts in a sequence of parts to compute a renderable audio composition of a predetermined length based on the aggregate duration. The sequence of parts may include, for example, a part of a starting function, at least one part of a looping function, and a part of an ending function. Other sequences defined by song structures may be employed.

Further, the parts may include part variations, such that each of the part variations has the same type and a particular independent duration of the audio content contained in the part. Arranging the series of parts further includes building a finished composition piece by iteratively selecting a next part for concatenation to the finished composition. Iterating through available parts includes examining the available parts for concatenation, and computing, based on aggregation rules, a type of part adapted for inclusion as the next part. The iteration computes, if the type of part is adapted for inclusion, part variations of the part, each part variation having a different duration, and selects, if a part variations having a corresponding duration is found, the part variation. The selected corresponding duration is operable to provide a predetermined duration to the finished composition from all of the aggregated parts.

In an example configuration, the recombiner employs aggregation rules for identifying a song structure, in which the song structure is indicative of a sequence of part types operable to provide an acceptable musical progression. The recombiner selects, for each iteration, a part variation having a type corresponding to the song structure. Particular arrangements determine a resizability attribute for each of the parts, and concatenate, if the part is resizable, multiple iterations of the part to achieve a desired aggregate (total) duration of the rearranged renderable part. If a part is resizable, the recombiner computes an optimal number of iterations based on the duration of available parts, the duration minimizing duplicative rendering of the rearranged parts.

Particular configurations determine a recombination mode, in which the recombination mode is operable to automatically arrange types of parts such that the part structure may be modified in the generated renderable sequence of parts.

Alternate configurations of the invention include a multiprogramming or multiprocessing computerized device such as a workstation, handheld or laptop computer or dedicated computing device or the like configured with software and/or circuitry (e.g., a processor as summarized above) to process any or all of the method operations disclosed herein as embodiments of the invention. Still other embodiments of the invention include software programs such as a Java Virtual Machine and/or an operating system that can operate alone or in conjunction with each other with a multiprocessing computerized device to perform the method embodiment steps and operations summarized above and disclosed in detail below. One such embodiment comprises a computer program product that has a computer-readable medium including computer program logic encoded thereon that, when performed in a multiprocessing computerized device having a coupling of a memory and a processor, programs the processor to perform the operations disclosed herein as embodiments of the invention to carry out data access requests. Such arrangements of the invention are typically provided as software, code and/or other data (e.g., data structures) arranged or encoded on a computer readable medium such as an optical medium (e.g., CD-ROM), floppy or hard disk or other medium such as firmware or microcode in one or more ROM or RAM or PROM chips, field programmable gate arrays (FPGAs) or as an Application Specific Integrated Circuit (ASIC). The software or firmware or other such configurations can be installed onto the computerized device (e.g., during operating system or execution environment installation) to cause the computerized device to perform the techniques explained herein as embodiments of the invention.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Conventional sound applications suffer from the shortcoming that modifying the duration (i.e. time length) of an audio piece tends to change the tempo because the compression and expansion techniques employed alter the amount of information rendered in a given time, tending to "speed up" or "slow down" the perceived audio (e.g. music). Further, conventional methods employing mechanical switching and mixing tend to introduce perceptible inconsistencies (i.e. "crackles" or "pops") as the audio information is switched, or transitions, from one portion to another. Configurations discussed below substantially overcome the shortcomings presented by conventional audio mixing and processing applications by defining an architecture and mechanism of storing audio information in a manner operable to be rearranged, or recombined, from discrete parts of the audio information. The resulting finished musical composition has a predetermined length from the constituent parts, rearranged by the rearranger without detectable inconsistencies between the integrated audio parts from which it is combined. Accordingly, configurations herein identify a decomposed set of audio information in a file format indicative of a time and relative position of parts of the musical score, or piece, and identify, for each part, a function and position in the recombined finished composition. Each of the stored parts is operable to be recombined into a seamless, continuous composition of a predetermined length providing a consistent user listening experience despite variations in duration.

Figure 1:
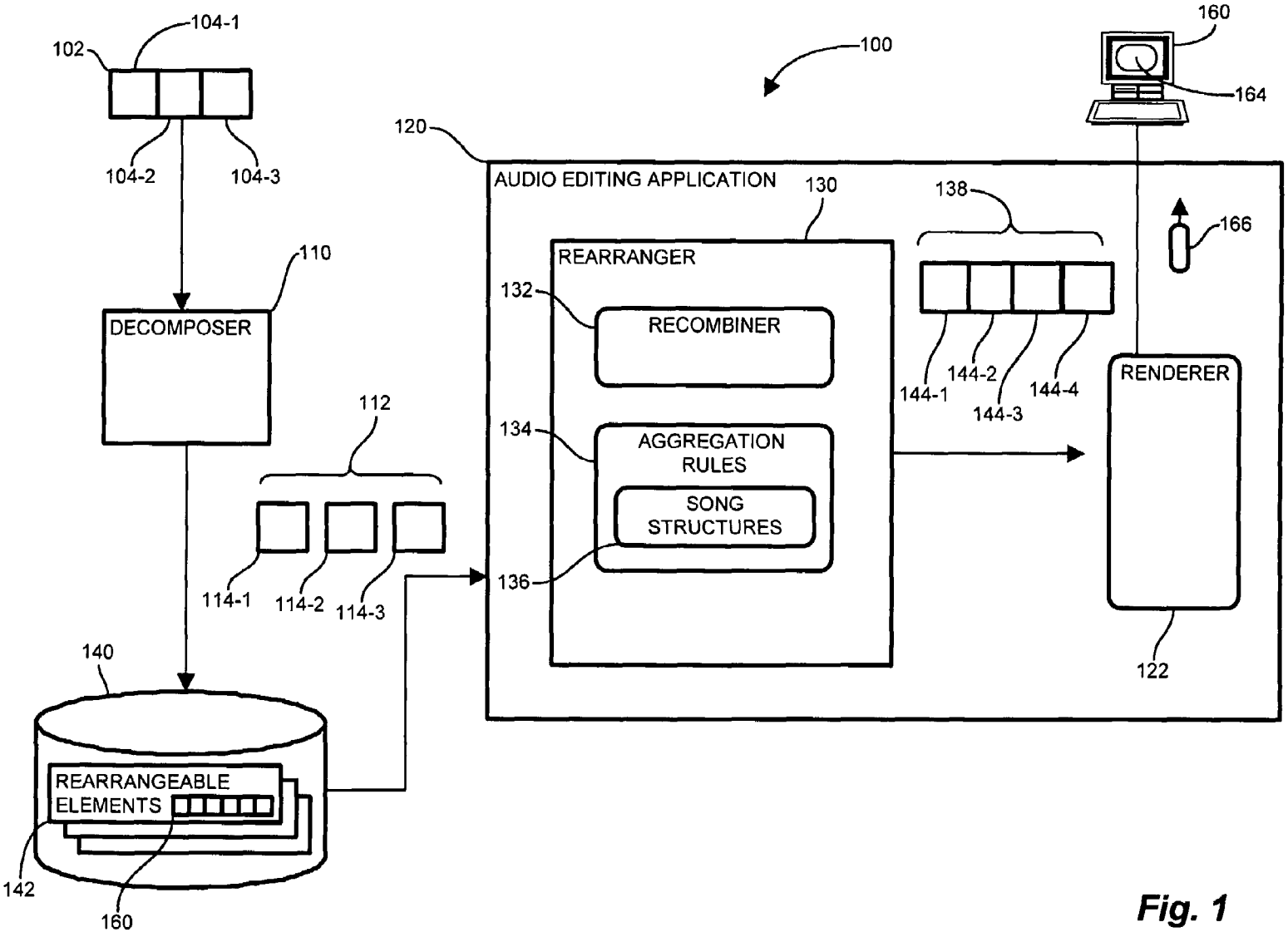
FIG. 1 is a context diagram of an exemplary audio development environment suitable for use with the present invention.

FIG. 1 is a context diagram of an exemplary audio development environment suitable for use with the present invention. Referring to FIG. 1, an audio editing environment 100 includes a decomposer 110 and an audio editing application 120. In an example configuration, the audio editing application may be the SOUNDBOOTH application, marketed commercially by Adobe Systems Incorporated, of San Jose, Calif. The audio editing application 120 includes a rearranger 130 for rearranging, or recombining, parts of a song, and a renderer 122 for rendering a finished (rearranged) audio composition 166 on a user device 160. The decomposer 110 is operable to receive a musical piece, or score 102, and decompose segments 104-1 . . . 104-3 corresponding to various portions of a song. Such portions include, for example, intro, chorus, verse, refrain, and bridge. The rearranger 130 receives the decomposed song 112 (or song) as a series of parts 114 corresponding to each of the segments 104 in the original score 102. The resulting rendered audio composition 166 is a rearranged composition having constituent parts 114 processed by the rearranger 130 as discussed further below. Processing by the rearranger 130 includes reordering and replicating parts 114 to suit a particular time constraint, and modifying characteristics of the parts 114 such as melody, harmony, intensity and volume. A graphical user interface 144 receives user input for specifying the rearranging and reordering of the parts 114 in the song.

The rearranger 130 further includes a recombiner 132, aggregation rules 134 and song structures 136. The recombiner 130 is operable to rearrange and reorder the parts 114 into a composition 138 of reordered segments 144-1 . . . 144-4 (144 generally) corresponding to the parts 114. Each of the segments 144 is a part variation having a particular duration, discussed further below. Each part variation 144 includes tracks having one or more clips, discussed below. The aggregation rules 134 employ a function of each of the parts 114 that indicates the order in which a particular part 114 may be recombined with other parts 114. In the example shown herein, the functions include starting, ending, and looping (repeatable) elements. Alternate parts having other functions may be employed; the recombinability specified by the function is granular to the clip and need not be the same for the entire part. The function refers to the manner in which the part, clip, or loop is combinable with other segments, and may be specific to the clip, or applicable to all clips in the part. The song structures 136 specify a structure, or type-based order, of each of the parts 114 used to combine different types of parts in a sequence that meets the desired duration. In the example configuration below, the recombiner 132 computes time durations of a plurality of parts 114 to assemble a composition 138 having a specified time length, or duration, received from the GUI 164.

In such a system, it is desirable to vary the length of a musical score, yet not deviate from the sequence of verses and intervening chorus expected by the listener. The rearranged composition 138 rendered to a user maintains an expected sequence of parts 114 (based on the function and type) to meet a desired time duration without varying the tempo by "stretching" or "compressing" the audio, while also preserving the musical "structure," or logical progression of the parts. It should be noted that the concept of a "part" as employed herein refers to a time delimited portion of the piece, not to a instrument "part" encompassing a particular single instrument.

The rearranger 130 employs the decomposed song 112, which is stored as a set of files indexed as rearrangable elements 142-1 . . . 142-N (142 generally) on a local storage device 140, such as a local disk drive. The rearrangable elements 142 collectively include parts 114, part variations 144, and tracks and clips, discussed further below in FIG. 3. In an example arrangement, the rearrangable elements 142 define a set of files named according to a naming convention indicative of the elements, and may include a part 114 or variations of a part 144, for example. Other suitable file arrangements may be employed for storing the elements 142.

Therefore, in an example arrangement, the rearranger 130 computes for a given song variation (time length variant of a song) the length of the song (rearranged composition) 138 by combining all parts 114 contained in this song variation 138. For each part 114 all part variations are iteratively attempted in combination with any part variation of the other parts 114 of the song variation. If the resulting song variation duration is smaller than the desired length, the repetition count for all parts is incremented part by part. The rearranger 130 iterates as long as the resulting duration is equal or larger than the desired length. During the iteration part variations 144 are marked to be removed from search if the duration keeps being under the desired length. The 138 rearranger searches for a combination which gives the minimal error towards the desired length. (149, FIG. 3) In an automatic mode, discussed further below, the result/best fit of each song variation is compared as such that the resulting minimal error and the repetition count over all parts of a song variation is chosen, where both values weighted equally are minimal.

Figure 2:
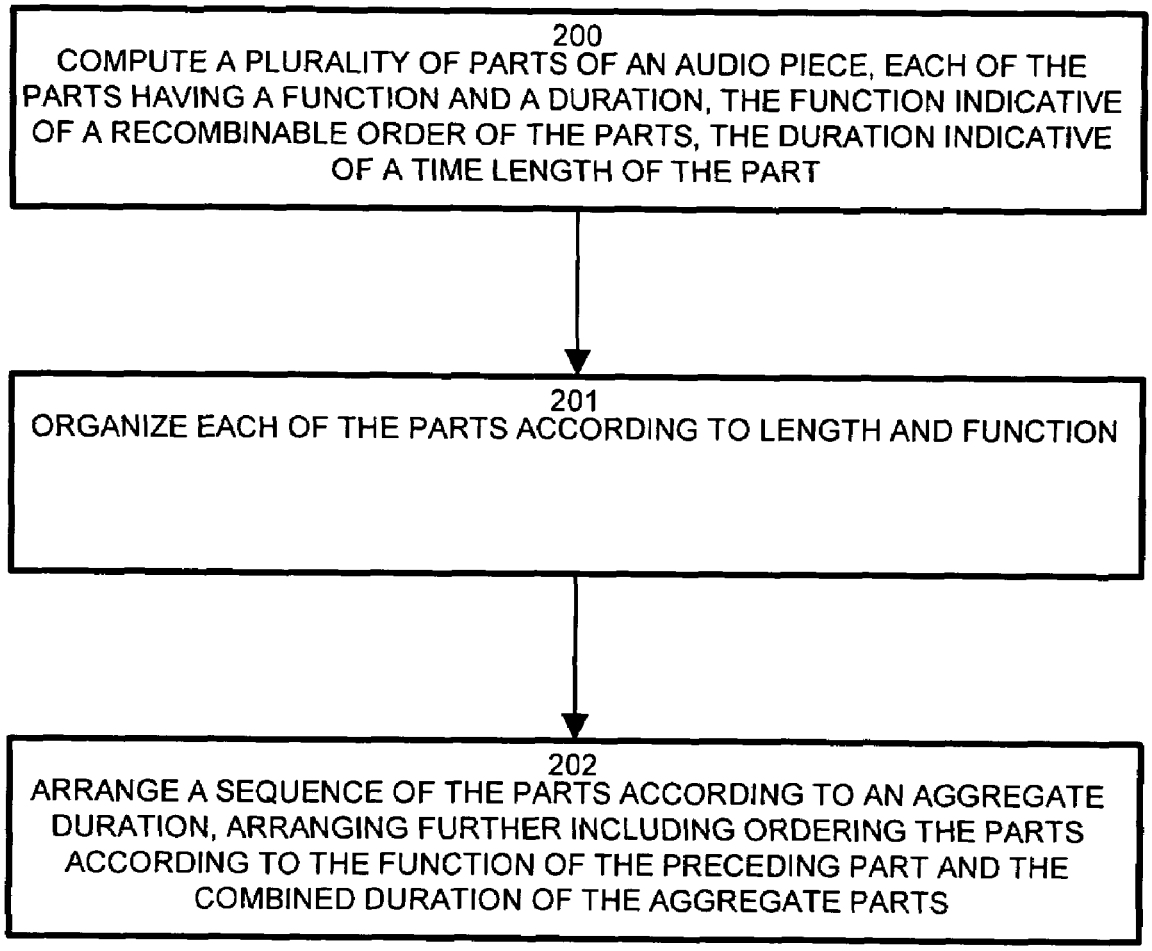
FIG. 2 is a flowchart of song rearrangement in the environment of FIG. 1.
Figure 3:
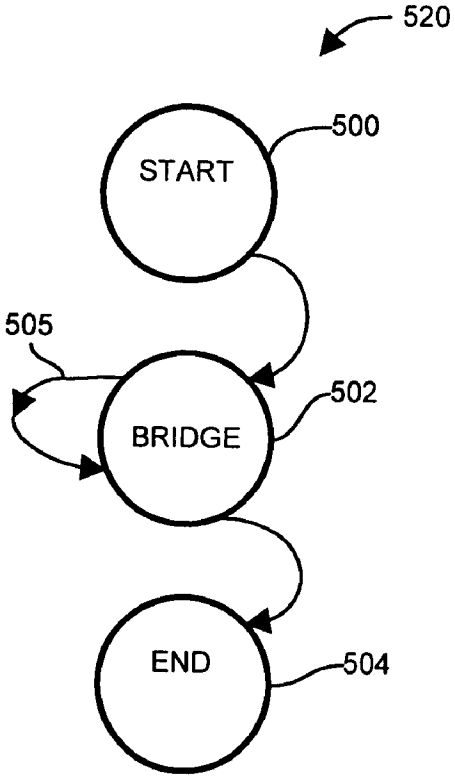

FIG. 2 is a flowchart of song rearrangement in the environment of FIG. 1. Referring to FIGS. 1 and 2, the method of processing audio information as defined herein includes, at step 200, computing a plurality of parts 114 of an audio piece, such that each of the parts 114 has a function and a duration, in which the function is indicative of a recombinable order of the parts 114, and the duration is indicative of a time length of the part 114. The function of a part, discussed further below in FIG. 3, is indicative of an ordering sequence of the parts in the finished composition 138. The duration specifies the time length such that the recombiner 132 orders the recombined parts 114 in the finished composition 138 to have a predetermined aggregate duration.

The decomposer 110 organizes each of the parts 114 according to length and function, as depicted at step 201, and decomposes the song into rearrangeable elements 160 typically stored as individual files of tracks and clips, although any suitable file organization may be employed. The rearrangeable elements 160 therefore form a set of files of parts, responsive to the rearranger 130 for rearranging and reordering the parts 114 into the finished composition 138 according to the aggregation rules 134 and the desired predetermined duration. The rearranger 130 arranges a sequence 112 of the parts 114 according to an aggregate duration, in which arranging further includes ordering the parts according to the function of the preceding part and the combined duration of the aggregate parts, as depicted at step 302. The function of the part 114 indicates position relative to other parts, such as parts types which may follow or precede another, also referred to as the structure, discussed further below with respect to FIGS. 3 and 4.

Figure 4:
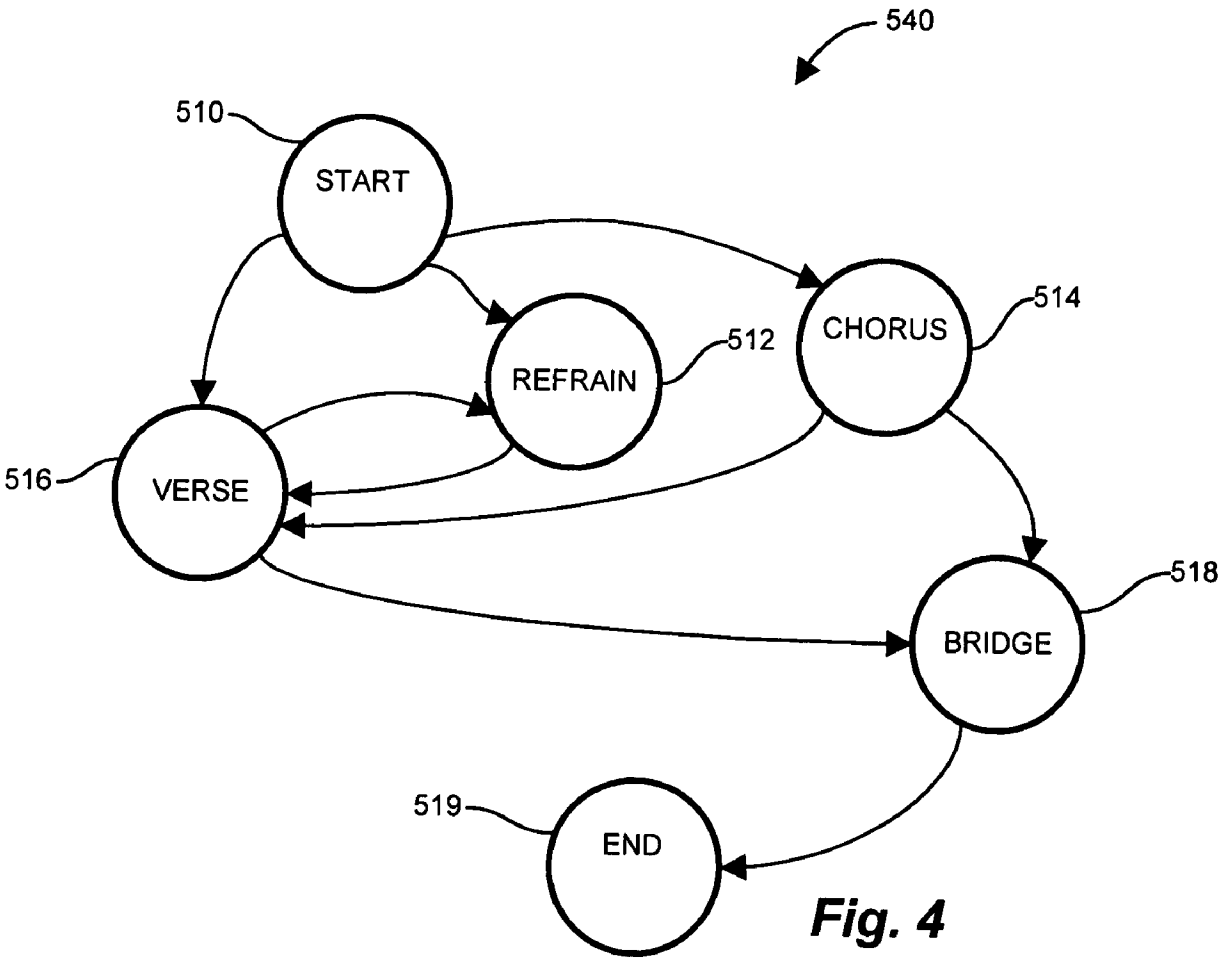
FIGS. 3-4 are exemplary song structures defined in the aggregation rules according to the system in FIG. 3.

FIGS. 3-4 are exemplary song structures defined in the aggregation rules according to the system in FIG. 1. Referring to FIGS. 3 and 4, FIGS. 3 and 4 show example song structures employable by the aggregation rules. The song structures 520, 540 maintain a logical musical progression that, when rendered to a user, provides a musically coherent, flowing composition. The song structure identifies a sequence of part 114 types, such as intro, verse, chorus, refrain and bridge. The structure id depicted as a state diagram showing an example transition to an acceptable "next" part; any suitable song structure may be employed, as long as the element (part, track and clip) structure specified by the rules may be determined. Alternate representations may be employed, such as a graph or matrix. Referring to FIG. 3, a simple structure having three parts is shown. An intro part 500 is followed by a bridge 502 and an end part 504. The bridge part 502 may be replicated, as shown by arrow 505. Thus, the rearranger begins aggregating the start part 502, followed by a multiple of the bridge part 502 to occupy most of the desired duration until there is just enough duration for the end part 504, and finally by the end part 504.

FIG. 4 shows a song structure 540 having 6 nodes indicative of part 114 progression. In FIG. 4, a start part 510 may be followed by a refrain 512 or chorus 514. The refrain 512 and verse 516 may alternate any number of times, and leads into the bridge 518. The chorus 514 is followed by the verse 516, and may also alternate between the refrain and verse, until leading to the bridge 518 which is followed by the end. The example song structures 520 and 540 shown are not restrictive, and may demonstrate any suitable sequence or transition of part types that presents a logical musical progression of parts that is renderable into a pleasing musical experience for the listener.

Figure 5:
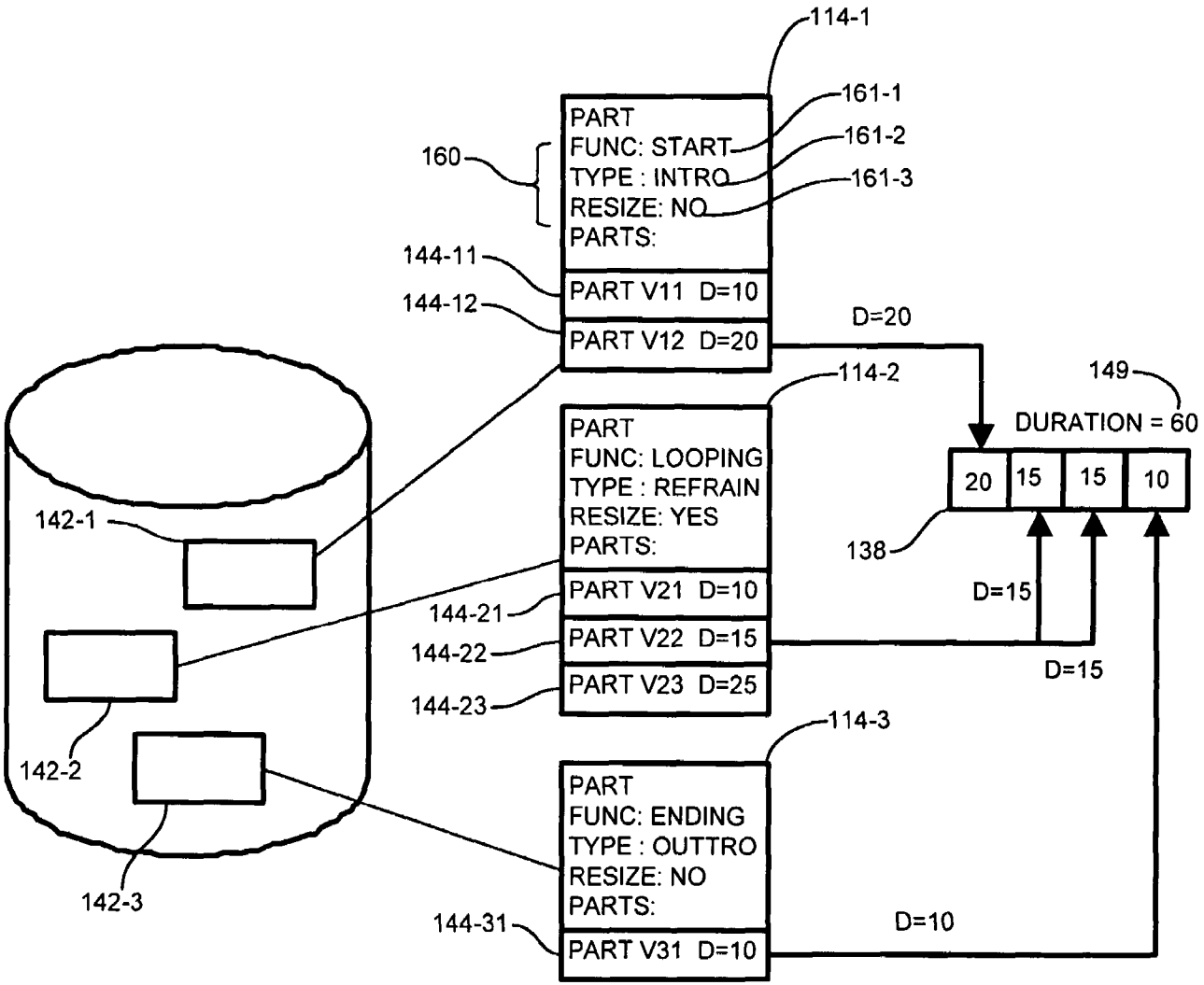
FIG. 5 is a block diagram of parts of a song being rearranged for a predetermined duration according to the flowchart of FIG. 2.
Figure 6:
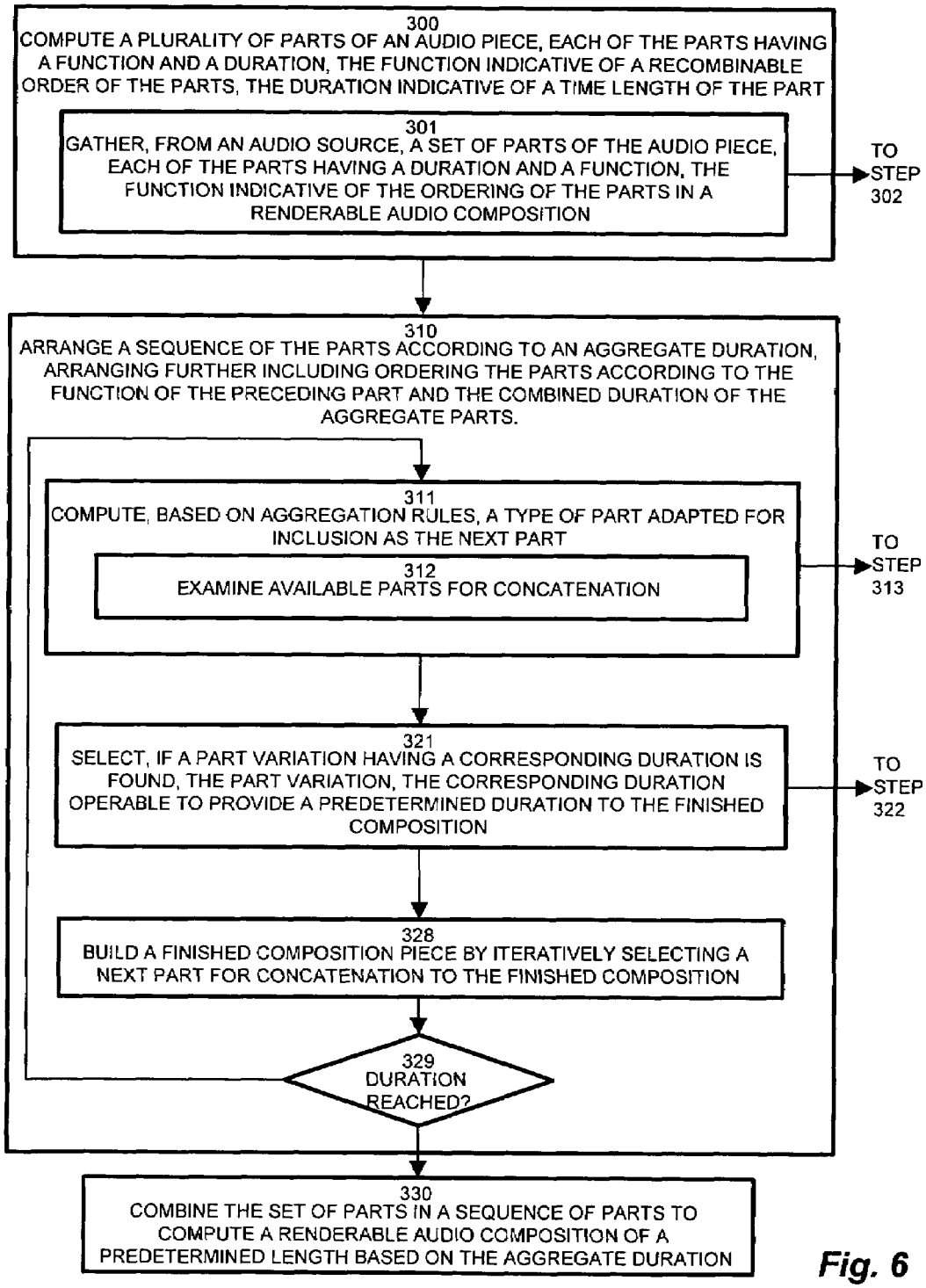
FIGS. 6-9 are a flowchart of rearrangement of parts of a song according to the aggregation rules in the system in FIG. 3.

FIG. 5 is a block diagram of parts of a song (score) 102 being modified according to the flowchart of FIG. 2. Referring to FIGS. 1 and 3, the local drive 140 stores the rearrangeable elements 142 as parts 114-1 . . . 114-3. The rearranger 130 accesses the elements 142 as files to extract the parts 114. Each part 114 has one or more part variations 144-11 . . . 144-31 (144-N generally). The part variations 144-N are a time varied segment 104 that generally provide a similar rendered experience and have the same part function and part type. The set of rearrangeable elements 142 therefore provides a range of time varied, recombinable elements 142 that may be processed and rearranged by the rearranger 130 to generate a rearranged composition 138 that provides a similar rendered experience with variable total duration. Each part further includes one or more tracks 146-1 . . . 146-N, and each track may include one or more clips 148-1 . . . 148-N. One particular usage is matching a soundtrack to a video segment. The soundtrack can be matched to the length of the video segment without deviating from the song structure of verses separated by a refrain/chorus and having an introductory and a finish segment (part).

In FIG. 5, the example rearranged composition 138 has four parts 144-1 . . . 144-4. A desired time 149 of 60 seconds is sought by the recombiner 132. The aggregation rules 134 indicate a song structure 136 that identifies part 114-1 as having a start function, part 114-2 as having a looping function, being of type bridge, and part 114-3 as having an ending function. The recombiner 132, responsible for selecting the various length part variations 144, selects part 144-12, having a duration of 20, two iterations (loops) of part 144-22, having a duration of 15 each, thus totaling 30 seconds, and part variation 144-31, having a duration of 10, totaling 60 seconds. An alternate composition 138 might include, for example, 5 parts having part types of intro, verse, chorus, verse, outtro, or other combination that preserves the sequence specified by the type, iterations specified by the function, and part variations that aggregate (total) to the desired time.

The parts 114 further include attributes 160, including a function 161-1, a type 161-2, and a resizability 161-3. The function 161-1 is indicative of the ordering of the parts in the composition 138. In the example configuration, the function indicates a starting, ending, or looping part. The type 161-2 is a musical designation of the part in a particular song, and may indicate a chorus, verse, refrain, bridge, intro, or outtro, for example. The type indicates the musical flow of one part into another, such as a chorus between verses, or a bridge leasing into a verse, for example. The resizability 161-3 indicates whether a part 114 may be replicated, or looped multiple of times, to increase the duration of the resulting aggregate parts 114. This may be related to the function 161-2 (i.e. looping), although not necessarily.

FIGS. 6-9 are a flowchart of rearrangement of parts of a song according to the aggregation rules in the system in FIG. 5. Referring to FIGS. 5 and 6-9, method of representing audio information as defined herein includes, at step 300, computing a plurality of parts of an audio piece, each of the parts having a function and a duration, such that the function indicative of a recombinable order of the parts, the duration indicative of a time length of the part. This includes gathering, from an audio source, a set of parts of the audio piece, each of the parts having a duration and a function, the function indicative of the ordering of the parts in a renderable audio composition, and storing the parts in an indexed or enumerated form, as the rearrangeable elements. For example, a script file, such as that defined in copending U.S. patent application entitled "METHODS AND APPARATUS FOR STRUCTURING AUDIO DATA", incorporated herein by reference, filed concurrently, may be employed. Further details on the rearrangeable elements are discussed below with respect to FIG. 7, at step 302.

The rearranger 130 arranging a sequence of the parts according to an aggregate duration, such that arranging further includes ordering the parts according to the function of the preceding part and the combined duration of the aggregate parts, as depicted at step 310. The aggregation rules, discussed further below with respect to FIGS. 8 and 9, perform rearranging with the intent to minimize duplication while satisfying the predetermined duration as closely as feasible with the aggregate parts. The recombiner 132 computes, based on the aggregation rules 134, a type of part 114 adapted for inclusion as the next part 114 in a sequence 112 accumulated as the finished composition 138, as shown at step 311. Accordingly, the recombiner 132 examines available parts 114 for concatenation, as depicted at step 312, to determine the sequence of part types 161 and durations D according to the aggregation rules 134 and song structures 136 that satisfies the intended duration 149, discussed further below in FIGS. 7 and 8.

The recombiner selects, if a part variation 144 having a corresponding duration D is found, the part variation 144, the corresponding duration operable to provide a predetermined duration to the finished composition 138, as shown at step 321. Using the selected part variation 144, the recombiner builds the finished composition 138 piece by iteratively selecting a next part for concatenation to the finished composition, ass depicted at step 328. Therefore, a check is performed, at step 329, to determine if the intended duration 149 is reached, and control reverts to step 311 accordingly. Otherwise, the renderer 122 combines the set of parts selected in the sequence of parts 138 to compute a renderable audio composition 166 of a predetermined length based on the aggregate duration, as shown at step 330.

Figure 7:
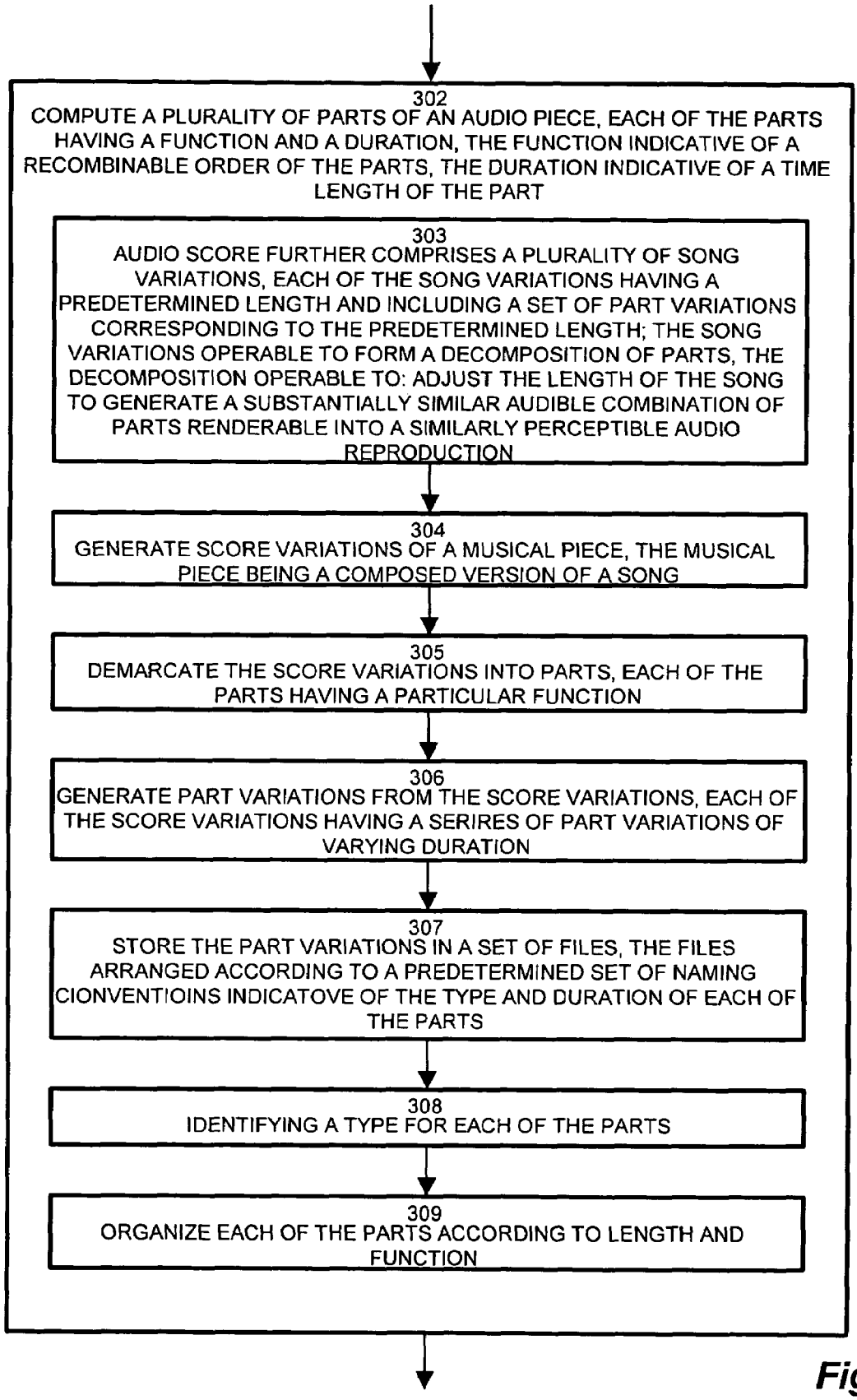

Referring now to FIG. 7, the decomposer 110 computes a plurality of parts of an audio piece 102, such that each of the parts has a function 161-1 and a duration D, in which the function 161-1 is indicative of a recombinable order of the parts 114, and the duration is indicative of a time length of the part 114. The parts 114, take the form of rearrangeable elements 142 available to the rearranger 130, in which the audio score 102 further comprises a plurality of song variations, such that each of the song variations has a predetermined length and includes a set of part variations 144 corresponding to the predetermined length. The song variations are operable to form a decomposition of parts 114, such that the decomposition is operable to adjust the length of the song to generate a substantially similar audible combination 138 of parts 114 renderable into a similarly perceptible audio reproduction 166, as disclosed at step 303. The decomposer generates or obtains the score (song) variations of a musical piece 102, the musical piece being a composed version of a song, as depicted at step 304, and demarcates the score variations into parts 114, each of the parts 114 having a particular function 161-1, as shown at step 305. The decomposer 110 generates part variations 144 from the score variations, such that each of the score variations has a series of part variations 144 of varying duration D, as disclosed at step 306. The local storage device 140 stores the part variations 144 as rearrangeable elements 142 in a set of files, in which the files are arranged according to a predetermined set of naming conventions indicative of the type and duration of each of the parts 114, as shown in step 307. For example, the rearrangeable elements may each occupy a particular file. Other levels of granularity may be achieved; in the example configuration, the files are named according to the methods in the copending U.S. patent application cited above. The decomposer 110 identifies a type 161-1 for each of the parts 114, as depicted at step 308, and organizes each of the parts according to length D and function 161-1, such as by the naming conventions, as shown at step 309.

Figure 8:
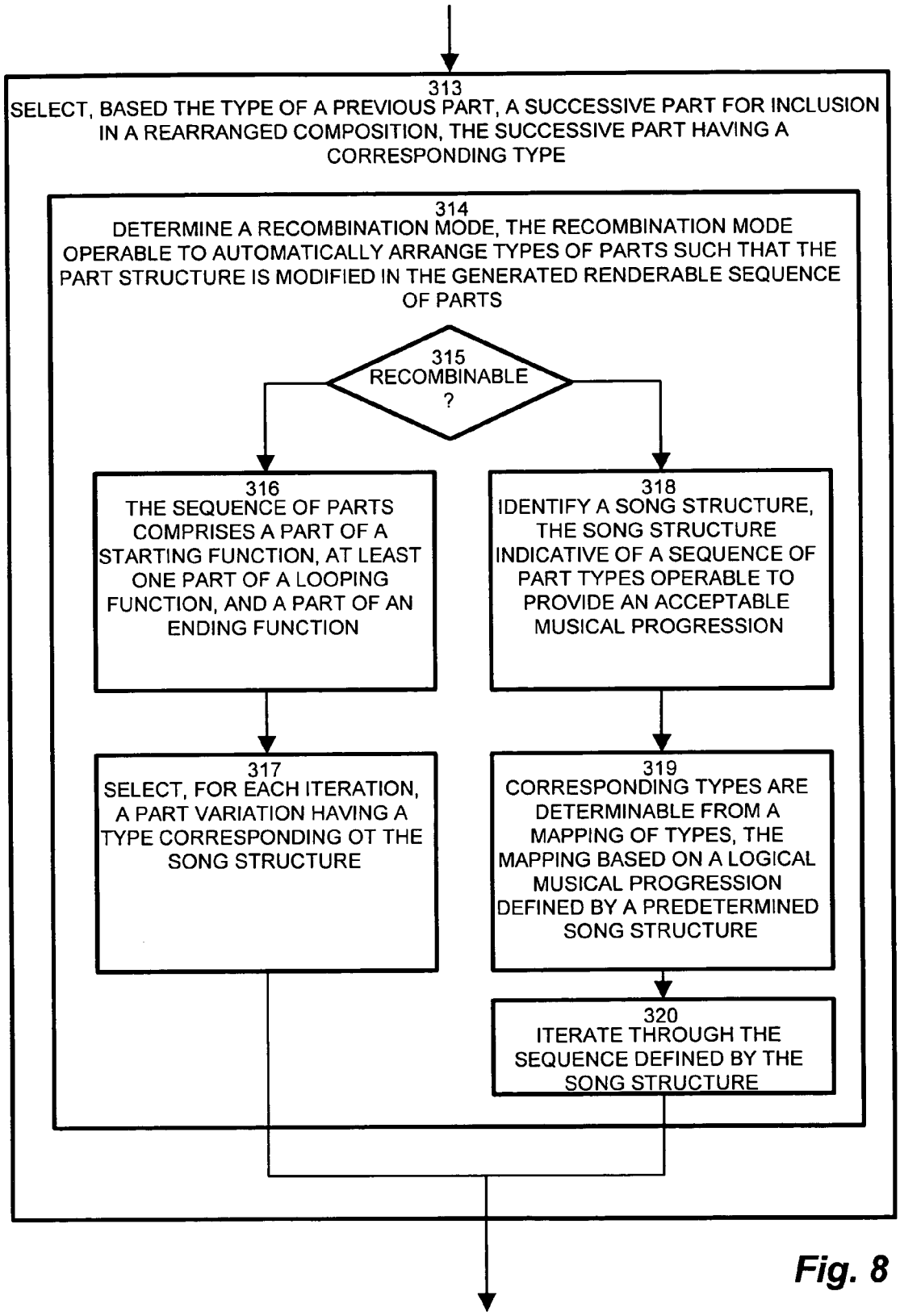

Referring to FIG. 8, from step 312, the recombiner selects, based on the type 161-1 of a previous part 114, a successive part 114 for inclusion in the rearranged composition 138, such that the successive part has a corresponding type, as depicted at step 313. Therefore, the recombiner iteratively selects parts variations 144 for concatenation, or aggregation, into the finished composition 138, based on the aggregation rules 134.

The recombiner determining a recombination mode, in which the recombination mode is operable to automatically arrange types of parts such that the part structure is modified in the generated renderable sequence of parts, as shown at step 314. A check is performed, at step 315, to determine if recombination is enabled, meaning that the recombination may rearrange the structure (sequence of types) in the finished composition 138. If the recombination mode is enabled, then the structure (e.g. part 114 type ordering) is preserved, for example, the sequence of parts 138 includes a part of a starting function 114-1, at least one part of a looping function 114-2, and a part of an ending function 114-3, as depicted at step 316. In this mode, the recombiner selects, for each iteration, a part variation having a type corresponding to the song structure of the input score 102, as shown at step 317.

Otherwise If the recombination mode is enabled, the aggregation rules 134 may be employed to identify permissible song structures 136, or sequences of part types 161-1. The aggregation rules 136 identify a song structure such that the song structure i136 is indicative of a sequence of part types 161-1 operable to provide an acceptable musical progression, as shown at step 318. The recombiner 132 selects, for each iteration, a part variation 144 having a type 161-1 corresponding to the song structure 136 permitted by the aggregation rules 134 (e.g. 520, 540). Other structures may be specified by the song structures 136. The corresponding types 161-1 are determinable from a mapping of types, the mapping based on a logical musical progression defined by a predetermined song structure (520, 540), as shown at step 319. The recombiner selects the next part type 161-1 by iterating through the sequence defined by the song structure 136, as shown at step 320.

Figure 9:
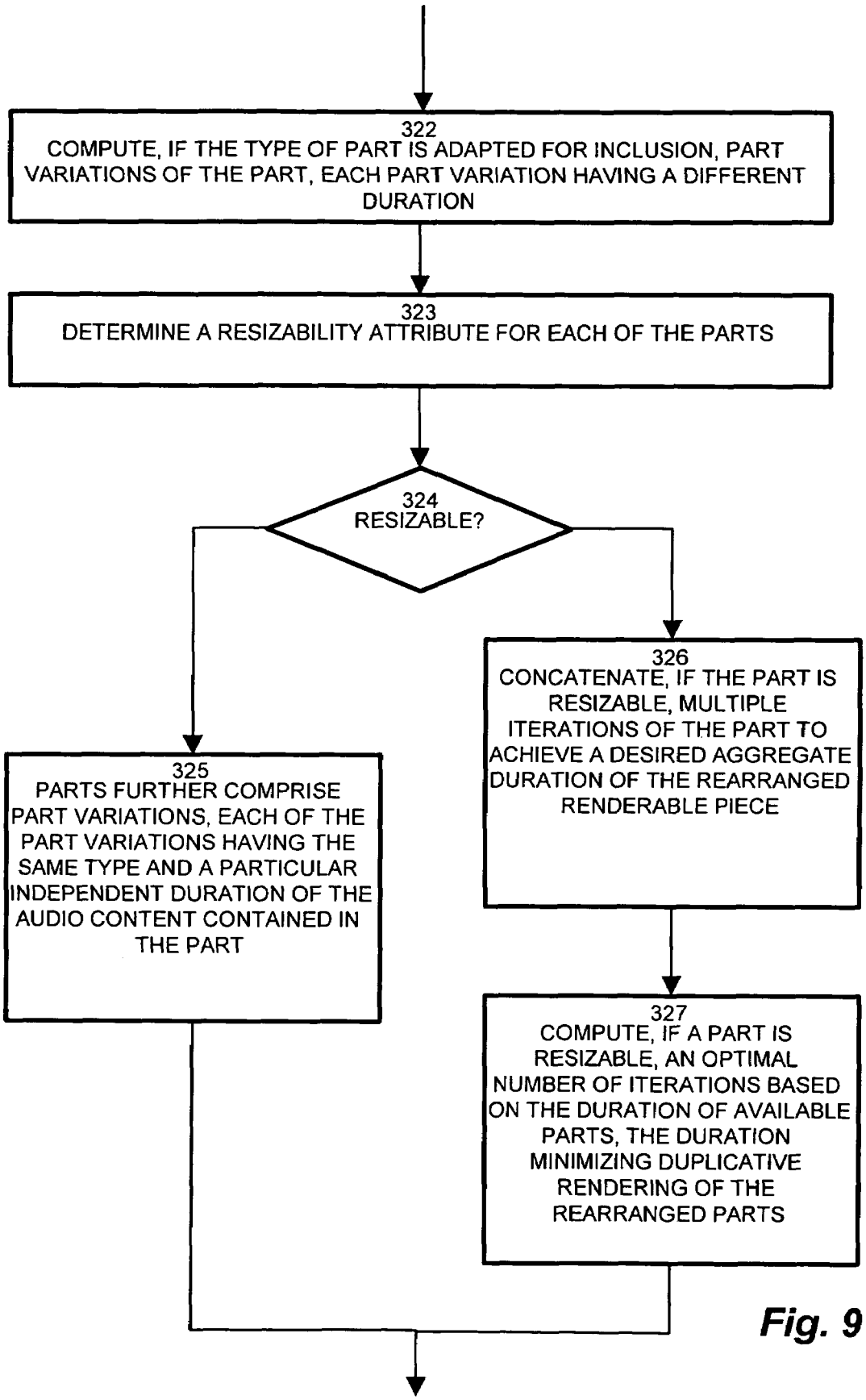

Referring to FIG. 9, while iterating (searching) for part variations corresponding to a duration 149, the recombiner 132 computes, if the type 161-1 of part is adapted for inclusion (based on the type check of step 312), part variations 144 of the part 114, such that each part variation has a different duration, as shown at step 322. The recombiner determining a resizability attribute for each of the parts, as depicted at step 323. The resizability indicates if multiple repetitions the part variation may be performed to achieve a desired duration. A check is performed, at step 324, to identify if a part variation 144 is resizable. If not, then the recombiner looks to part variations 144, in which each of the part variations has the same type and a particular independent duration of the audio content contained in the part, as shown at step 325, to identify a part variation of an appropriate length.

Otherwise, at step 326, the recombiner concatenates, if the part is resizable, multiple iterations of the part 114 to achieve a desired aggregate duration of the rearranged renderable piece 138. In view of minimizing repetition, the aggregation rules specify repetition of the largest part that can be accommodated. Therefore, the recombiner computes, if a part is resizable, an optimal number of iterations based on the duration of available parts 114 (i.e. part variations 144), such that the duration minimizes duplicative rendering of the rearranged parts. Thus, 2 multiples of a 10 second part variation 144 are preferred to 4 multiples of a 5 second variation, for example.

Those skilled in the art should readily appreciate that the programs and methods for representing and processing audio information as defined herein are deliverable to a processing device in many forms, including but not limited to a) information permanently stored on non-writeable storage media such as ROM devices, b) information alterably stored on writeable storage media such as floppy disks, magnetic tapes, CDs, RAM devices, and other magnetic and optical media, or c) information conveyed to a computer through communication media, for example using baseband signaling or broadband signaling techniques, as in an electronic network such as the Internet or telephone modem lines. The disclosed method may be in the form of an encoded set of processor based instructions for performing the operations and methods discussed above. Such delivery may be in the form of a computer program product having a computer readable medium operable to store computer program logic embodied in computer program code encoded thereon, for example. The operations and methods may be implemented in a software executable object or as a set of instructions embedded in a carrier wave. Alternatively, the operations and methods disclosed herein may be embodied in whole or in part using hardware components, such as Application Specific Integrated Circuits (ASICs), Field Programmable Gate Arrays (FPGAs), state machines, controllers or other hardware components or devices, or a combination of hardware, software, and firmware components.

While the system and method for representing and processing audio information has been particularly shown and described with references to embodiments thereof, it will be understood by those skilled in the art that various changes in form and details may be made therein without departing from the scope of the invention encompassed by the appended claims.

What is claimed is:

1. A method of rendering audio information comprising:

computing a plurality of parts of an audio piece, each of the parts having a function and a duration, the function indicative of a recombinable order of the parts, the duration indicative of a time length of the part, wherein computing includes identifying the function for each of the parts, the function comprising one of: a starting part, a looping part and an ending part;

organizing each of the parts according to length and function; and arranging a sequence of the parts according to an aggregate duration, arranging further including ordering the parts according to the function of the preceding part and the combined duration of the aggregate parts, which includes:

building a finished composition piece by iteratively selecting a next part for concatenation to the finished composition, iterating further comprising:

examining available parts for concatenation;

computing, based on aggregation rules, a type of part adapted for inclusion as the next part;

computing, if the type of part is adapted for inclusion, part variations of the part, each part variation having a different duration; and selecting, if a part variation having a corresponding duration is found, the part variation, the corresponding duration operable to provide a predetermined duration to the finished composition, wherein selecting includes: selecting a final part for the finished composition from a group of ending part variations, each ending part variation based on the ending part in the audio piece, the group of ending part variations including at least: a first ending part variation and a second ending part variation, a duration of the first ending part variation differing from a duration of the second ending part variation;

wherein the steps of computing, organizing, arranging and selecting are performed by at least one tangible computing device.

2. The method of claim 1 wherein arranging further comprises:

gathering, from an audio source, a set of parts of the audio piece, each of the parts having a duration and a function, the function indicative of the ordering of the parts in a renderable audio composition; and combining the set of parts in a sequence of parts to compute a renderable audio composition of a predetermined length based on the aggregate duration.

3. The method of claim 2 wherein the sequence of parts comprises a part of a starting function, at least one part of a looping function, and a part of an ending function.

4. The method of claim 3 wherein parts further comprise part variations, each of the part variations having the same type and a particular independent duration of the audio content contained in the part.

5. The method of claim 1 further comprising identifying a song structure, the song structure indicative of a sequence of part types operable to provide an acceptable musical progression; and selecting, for each iteration, a part variation having a type corresponding to the song structure.

6. The method of claim 5 further comprising:

determining a resizability attribute for each of the parts, and concatenating, if the part is resizable, multiple iterations of the part to achieve a desired aggregate duration of the rearranged renderable piece.

7. The method of claim 6 further comprising computing, if a part is resizable, an optimal number of iterations based on the duration of available parts, the duration minimizing duplicative rendering of the rearranged parts.

8. The method of claim 7 further comprising determining a recombination mode, the recombination mode operable to automatically arrange types of parts such that the part structure is modified in the generated renderable sequence of parts.

9. The method of claim 2 wherein gathering parts further comprises:

generating score variations of a musical piece, the musical piece being a composed version of a song;

demarcating the score variations into parts, each of the parts having a particular function;

generating part variations from the score variations, each of the score variations having a series of part variations of varying duration; and storing the part variations in a set of files, the files arranged according to a predetermined set of naming conventions indicative of the type and duration of each of the parts.

10. The method of claim 2 wherein combining further comprises:

identifying a type for each of the parts;

selecting, based the type of a previous part, a successive part for inclusion in a rearranged composition, the successive part having a corresponding type, wherein corresponding types are determinable from a mapping of types, the mapping based on a logical musical progression defined by a predetermined song structure.

11. The method of claim 10 wherein the audio score further comprises a plurality of song variations, each of the song variations having a predetermined length and including a set of musical segments corresponding to the predetermined length; the song variations operable to form a decomposition of parts, the decomposition integratable with the other parts in a seamless manner that avoids unwanted audible artifacts, the resulting integration operable to adjust the length of the song to generate a substantially similar audible combination of parts renderable into a similarly perceptible audio reproduction.

12. An information processing device comprising:

a decomposer operable to compute a plurality of parts of an audio piece, each of the parts having a function and a duration, the function indicative of a recombinable order of the parts, the duration indicative of a time length of the part, wherein the decomposer identifies the function for each of the parts, the function comprising one of: a starting part, a looping part and an ending part;

a repository responsive to the decomposer operable to organize each of the parts according to length and function; and a rearranger operable to arranging a sequence of the parts according to an aggregate duration, arranging further including ordering the parts according to the function of the preceding part and the combined duration of the aggregate parts, wherein the rearranger is further operable to build a finished composition piece by iteratively selecting a next part for concatenation to the finished composition, further comprising:

aggregation rules operable to compute a type of part adapted for inclusion as the next part, the rearranger further operable to:

compute, if the type of part is adapted for inclusion, part variations of the part, each part variation having a different duration;

select, if a part variations having a corresponding duration is found, the part variation, the corresponding duration operable to provide a predetermined duration to the finished composition, wherein the rearranger selects a final part for the finished composition from a group of ending part variations, each ending part variation based on the ending part in the audio piece, the group of ending part variations including at least: a first ending part variation and a second ending part variation, a duration of the first ending part variation differing from a duration of the second ending part variation.

13. The device of claim 12 wherein the rearranger further comprises:

an interface to the repository operable to gather, from an audio source, a set of parts of the audio piece, each of the parts having a duration and a function, the function indicative of the ordering of the parts in a renderable audio composition; and a recombiner operable to combine the set of parts in a sequence of parts to compute a renderable audio composition of a predetermined length based on the aggregate duration.

14. The device of claim 13 wherein parts further comprise part variations, each of the part variations having the same type and a particular independent duration of the audio content contained in the part.

15. The device of claim 12 wherein the aggregation rules further include a song structure, the song structure indicative of a sequence of part types operable to provide an acceptable musical progression, the aggregation rules operable to select for each iteration, a part variation having a type corresponding to the song structure.

16. The device of claim 15 wherein the recombiner is further operable to:

determine a resizability attribute for each of the parts; and concatenate, if the part is resizable, multiple iterations of the part to achieve a desired aggregate duration of the rearranged renderable piece.

17. The device of claim 16 wherein the recombiner is further operable to compute, if a part is resizable, an optimal number of iterations based on the duration of available parts, the duration minimizing duplicative rendering of the rearranged parts.

18. The device of claim 17 wherein the aggregation rules are further operable to determine a recombination mode, the recombination mode operable to automatically arrange types of parts such that the part structure is modified in the generated renderable sequence of parts.

19. The device of claim 13 wherein the recombiner is further operable to generate score variations of a musical piece, the musical piece being a composed version of a song;

demarcate the score variations into parts, each of the parts having a particular function;

generate part variations from the score variations, each of the score variations having a series of part variations of varying duration; and store the part variations in a set of files, the files arranged according to a predetermined set of naming conventions indicative of the type and duration of each of the parts.

20. The device of claim 13 wherein the recombiner is further operable to:

identify a type for each of the parts;

select, based the type of a previous part, a successive part for inclusion in a rearranged composition, the successive part having a corresponding type, wherein:

corresponding types are determinable from a mapping of types, the mapping based on a logical musical progression defined by a predetermined song structure.

21. A computer program product having a computer readable medium operable to store computer program logic embodied in computer program code encoded thereon as an encoded set of processor based instructions for performing a method for processing audio data comprising:

computer program code for computing a plurality of parts of an audio piece, each of the parts having a function and a duration, the function indicative of a recombinable order of the parts, the duration indicative of a time length of the part wherein computing includes identifying the function for each of the parts, the function comprising one of: a starting part, a looping part and an ending part;

computer program code for organizing each of the parts according to length and function; and computer program code for arranging a sequence of the parts according to an aggregate duration, arranging further including ordering the parts according to the function of the preceding part and the combined duration of the aggregate parts;

computer program code for wherein the computer program code for arranging the series of parts further comprises:

computer program code for examining available parts for concatenation;

computer program code for selecting a next part for concatenation to the finished composition computer program code for computing, based on aggregation rules, a type of part adapted for inclusion as the next part;

computer program code for computing, if the type of part is adapted for inclusion, part variations of the part, each part variation having a different duration;

computer program code for selecting, if a part variations having a corresponding duration is found, the part variation, the corresponding duration operable to provide a predetermined duration to the finished composition, wherein selecting includes:

selecting a final part for the finished composition from a group of ending part variations, each ending part variation based on the ending part in the audio piece, the group of ending part variations including at least: a first ending part variation and a second ending part variation, a duration of the first ending part variation differing from a duration of the second ending part variation.

22. The method as in claim 1, further comprising:

defining a first musical designation type for the group of ending function parts, the first musical designation type comprising an outro;

defining a second musical designation type for a group of starting function parts, the second musical designation type comprising an intro;

selecting an initial part for the finished composition from the group of starting function parts, the group of starting function parts includes at least: a first starting part version and a second starting part version, a duration of the first starting part version differing from a duration of the second starting part version;

defining a third musical designation type for at least one group of looping function parts, the third musical designation type comprising one of a chorus, verse, refrain, and a bridge; and selecting at least one middle part for the finished composition from the at least one group of looping function parts, the at least one group of looping function parts includes at least: a first looping part version and a second looping part version, a duration of the first looping part version differing from a duration of the second looping part version, the first musical designation type, the second musical designation type and the third musical designation type defined from a mapping of types, the mapping based on a logical musical progression defined by a predetermined song structure.

* * * * *